US006405493B1

(12) United States Patent
Taylor

(10) Patent No.: US 6,405,493 B1
(45) **Date of Patent: *Jun. 18, 2002**

(54) MOTION-MAGNIFYING SEISMIC SHOCK-ABSORBING CONSTRUCTION

(75) Inventor: Douglas P. Taylor, North Tonawanda, NY (US)

(73) Assignee: Tayco Developments, Inc., North Tonawanda, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/846,578

(22) Filed: May 1, 2001

Related U.S. Application Data

(63) Continuation of application No. 09/369,616, filed on Aug. 6, 1999, now Pat. No. 6,247,275.

(51) Int. Cl.[7] ..... E04B 1/98
(52) U.S. Cl. ..... 52/167.3; 52/167.1
(58) Field of Search ..... 52/167.1, 167.3

(56) References Cited

U.S. PATENT DOCUMENTS

| | | | | |
|---|---|---|---|---|
| 4,223,506 A | * | 9/1980 | Blair | 52/167.1 X |
| 4,910,929 A | | 3/1990 | Scholl | |
| 4,922,667 A | | 5/1990 | Kobori et al. | |
| 5,271,197 A | | 12/1993 | Uno et al. | |
| 5,727,663 A | | 3/1998 | Taylor | |
| 5,819,484 A | * | 10/1998 | Kar | 52/167.3 |
| 5,870,863 A | | 2/1999 | Taylor | |
| 5,934,028 A | | 8/1999 | Taylor | |

FOREIGN PATENT DOCUMENTS

| | | | | |
|---|---|---|---|---|
| JP | 353019655 | * | 2/1978 | 52/167.3 |
| JP | 1-284639 | | 11/1989 | |
| JP | 401318627 | * | 12/1989 | 52/167.3 |
| SU | 1507944 | * | 9/1989 | 52/167.3 |

* cited by examiner

*Primary Examiner*—Peter R. Brown
(74) *Attorney, Agent, or Firm*—Joseph P. Gastel

(57) ABSTRACT

A motion-magnifying seismic shock-absorbing construction for placement in the frame of an extremely stiff building structure wherein there is a relatively small horizontal movement between the floors of the building in response to a seismic event including a first link connected to the structure and having a shock-absorbing member therein, a plurality of additional links connected between the structure and the first link to transmit to the first link and to the shock-absorbing member therein the relatively small horizontal movement between the floors of the structure due to the seismic event, and the plurality of links including a motion-magnifying linkage for magnifying the aforementioned relatively small relative movement so that a magnified movement is applied to the shock-absorbing member. A building structure containing a plurality of the above motion-magnifying shock-absorbing constructions.

7 Claims, 3 Drawing Sheets

MOTION-MAGNIFYING SEISMIC SHOCK-ABSORBING CONSTRUCTION

CROSS-REFERENCE TO RELATED APPLICATIONS

This application is a continuation of Ser. No. 09/369,616 filed Aug. 6, 1999, now U.S. Pat. No. 6,247,275.

BACKGROUND OF THE INVENTION

The present invention relates to a motion magnifying seismic shock-absorbing construction for use in buildings which are extremely rigid.

By way of background, in buildings which are extremely stiff, such as massive concrete buildings, the relative horizontal movements of floors in response to seismic shock are not sufficiently large so as to permit toggle linkages, such as shown in U.S. Pat. No. 5,870,863, to transmit sufficient movement to dampers which absorb the seismic shock. It is with an improvement to seismic linkages of the foregoing type for use in such extremely stiff buildings that the present invention is concerned.

BRIEF SUMMARY OF THE INVENTION

It is the object of the present invention to provide motion-magnifying seismic shock-absorbing construction for magnifying the distance resulting from the relative movement of floors of an extremely stiff building resulting from seismic shock so that such magnified movement can be transmitted to seismic dampers for absorbing the shock causing such relative movement.

Another object of the present invention is to provide an improved stiff building structure containing a plurality of motion-magnifying seismic shock-absorbing linkages for magnifying the distance resulting from the relative movement of the floors of an extremely stiff building resulting from seismic shock so that such magnified movement can be transmitted to seismic dampers for absorbing the shock causing such relative movement. Other objects and attendant advantages of the present invention will readily be perceived hereafter.

The present invention relates to a motion-magnifying seismic shock-absorbing construction for placement in the frame of a building comprising a first link including a shock-absorbing member, a second link, and a motion-magnifying linkage connecting said first and second links.

The present invention also relates to a building structure having a frame and floors which move horizontally relative to each other in response to a seismic event, the improvement of a plurality of motion-magnifying shock-absorbing constructions each comprising a first link including a shock-absorbing member therein attached to said frame, a second link attached to said frame, and a motion-magnifying linkage attached between said first and second links.

The various aspects of the present invention will be more fully understood when the following portions of the specification are read in conjunction with the accompanying drawings wherein:

DETAILED DESCRIPTION OF THE INVENTION

Summarizing briefly in advance, the improved motion-magnifying seismic shock-absorbing constructions of the present invention are intended for use in building structures which are extremely stiff, such as massive concrete buildings, in which the relative horizontal movements of the floors such as 4, 6 and 8 in response to a seismic event are not sufficiently large so as to permit toggle linkages, such as shown in U.S. Pat. No. 5,870,863 and allowed application Ser. No. 08/975,129, filed Nov. 20, 1997, now U.S. Pat. No. 5,934,028, to transmit sufficient movement to the dampers which absorb the seismic shock.

Figure 1:
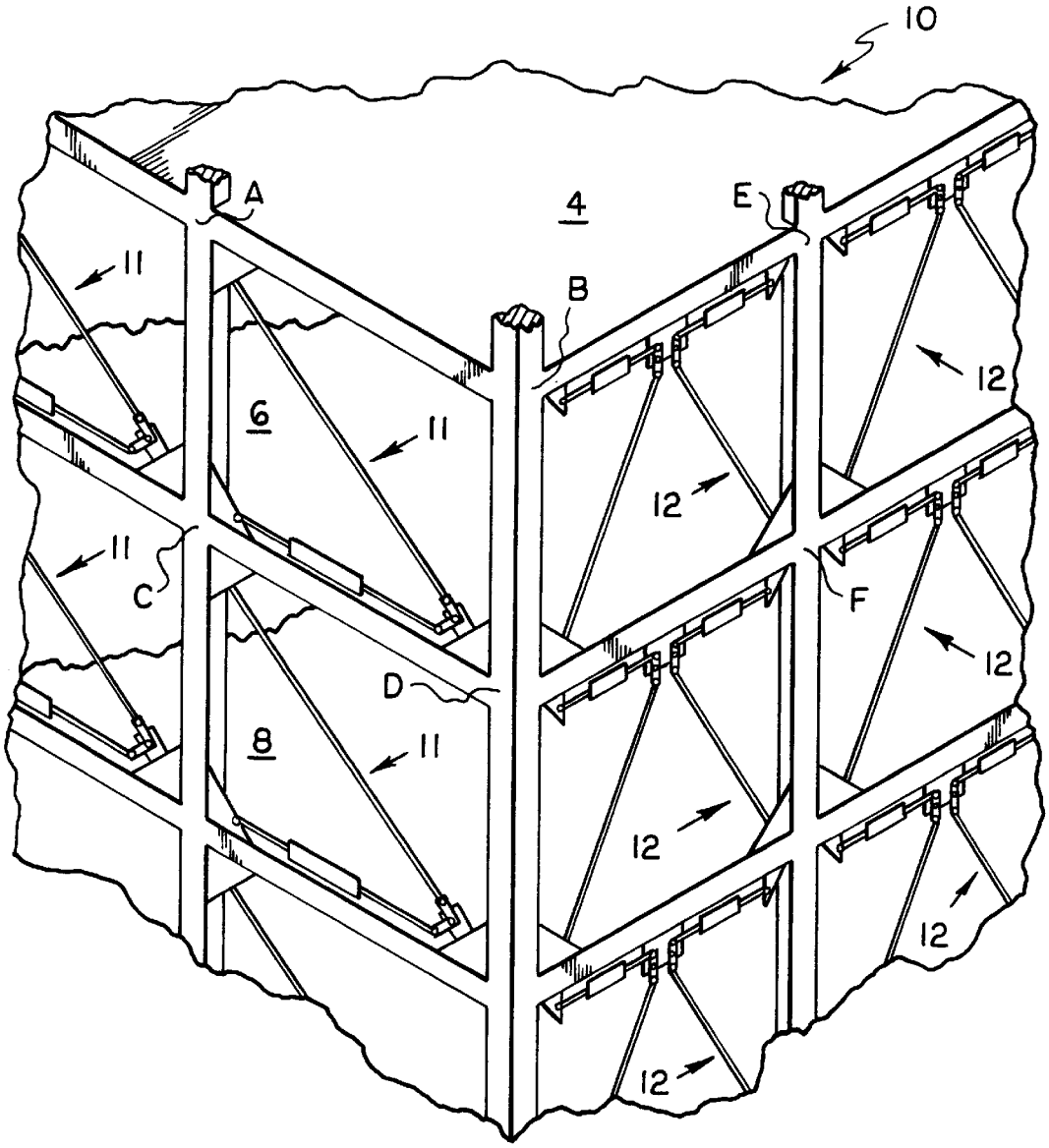
FIG. 1 is a schematic perspective view of a building having a plurality of different motion-magnifying seismic damping linkages of the present invention installed therein.

In FIG. 1 a fragmentary schematic view of a building is shown wherein lever-type seismic isolating linkages 11 are shown in certain frames and chevron types of linkages 12 are shown in other frames. The different types of linkages 11 and 12 are shown in the same structure merely by way of example. It will be understood that a building may include either type of the seismic isolating structures 11 or 12 or it may include a combination thereof.

In building frame ABCD (FIG. 2) an elongated link 13 is shown having an end 14 welded to gusset 15. The opposite end of link 13 is pivotally connected at 17 to motion-magnifying lever type of link 19 which has its central portion pivotally mounted at 20 on structural member 21 which is rigidly secured to gusset 22. The opposite end of link 19 is pivotally connected at 23 to piston rod 24 of shock-absorbing member 25 which in turn is pivotally connected at 27 to gusset 29 by link 30. Link 30, shock-absorbing member 25 and piston 24 thereof constitute a link between gusset 29 and motion-magnifying link 19.

While the connections between various of the links and the frame ABCD has been shown as utilizing gussets, it will be appreciated that the links can be connected in any manner whatsoever which will hold them in the proper position. In addition, while the connections 17, 23 and 27 have been shown as pivots, the connections may be of the types disclosed in U.S. Pat. No. 5,870,863 and allowed application Ser. No. 08/975,129, filed Nov. 20, 1997, now U.S. Pat. No. 5,934,028, which are incorporated herein by reference.

Figure 2:
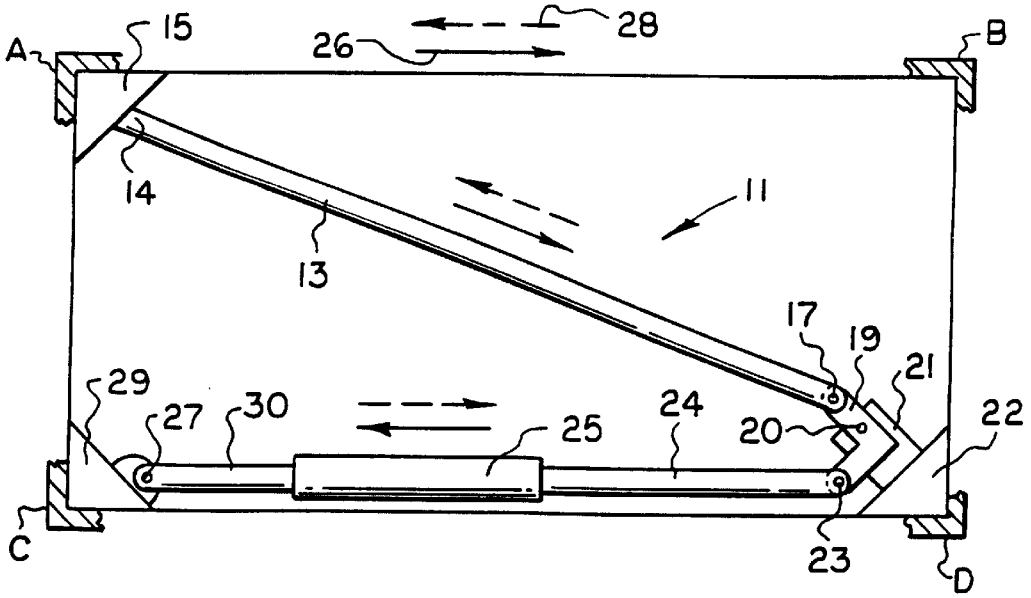
FIG. 2 is a schematic view of one embodiment of the improved linkage of the present invention installed in a frame of a building.
Figure 3:
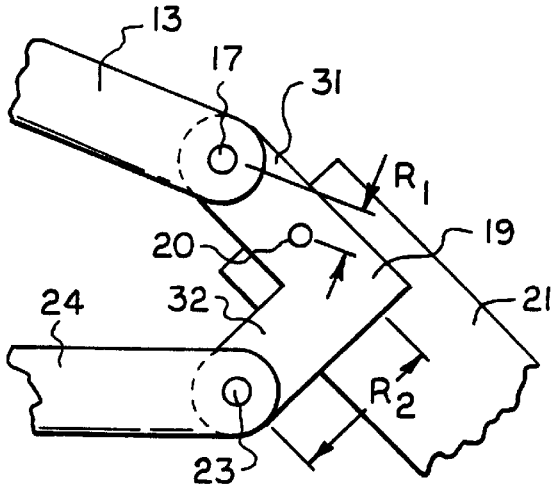
FIG. 3 is an enlarged fragmentary schematic view of a portion of FIG. 2.

An enlarged portion of FIG. 2 is schematically shown in FIG. 3, which is not to scale. In this figure the lever 19 has arms 31 and 32. The connection between link 13 and arm 31 is in the nature of a toggle linkage because link 13 and arm 31 are practically in a straight line. The magnification of the movement of link 13 to piston rod 24 is the ratio of length $R_2$ to length $R_1$. Therefore, if the toggle linkage itself provides a motion magnification of about 3:1 and when the ratio of length $R_2$ to length $R_1$ provides a magnification of 4:1, the motion transmitted to damper 25 will be 12:1, which is adequate for a very rigid building.

In FIG. 2 when the floor 4 along frame member AB moves in the direction of solid arrow 26 relative to the floor 6 along frame member CD, the various links will move in the corresponding directions designated by solid arrows. When the floor 4 along frame member AB moves in the direction of dash arrow 28 relative to the floor 6 along frame member CD, the links will move in the corresponding directions also designated by dash arrows.

Figure 4:
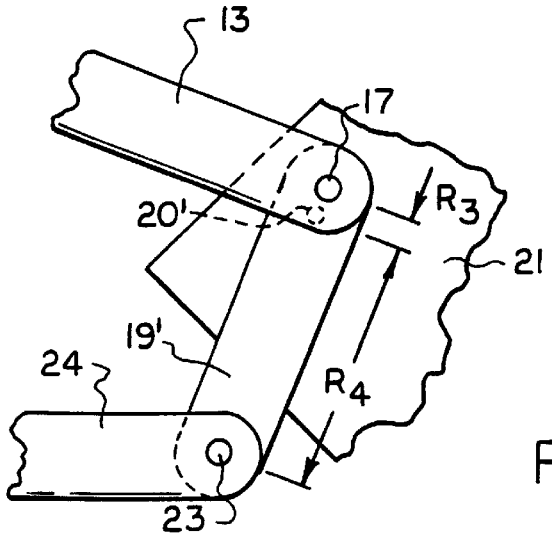
FIG. 4 is a enlarged fragmentary schematic view of another embodiment of a linkage which can be used in an installation such as shown in FIG. 2.

In FIG. 4 a more conventional type of lever type of link 19' is schematically shown as compared to the lever type of link 19 of FIG. 3 which provides the toggle-type of action. Link 19' is pivoted at 20' which is located on the central portion of member 21. In FIG. 4 the magnification of the movement of link 13 which is applied to the link containing shock-absorbing member 25 is the ratio of length $R_4$ to length $R_3$. In this embodiment the magnification is solely due to the ratio $R_4$ to $R_3$, and it should be about 10:1 for a very rigid building.

Figure 5:
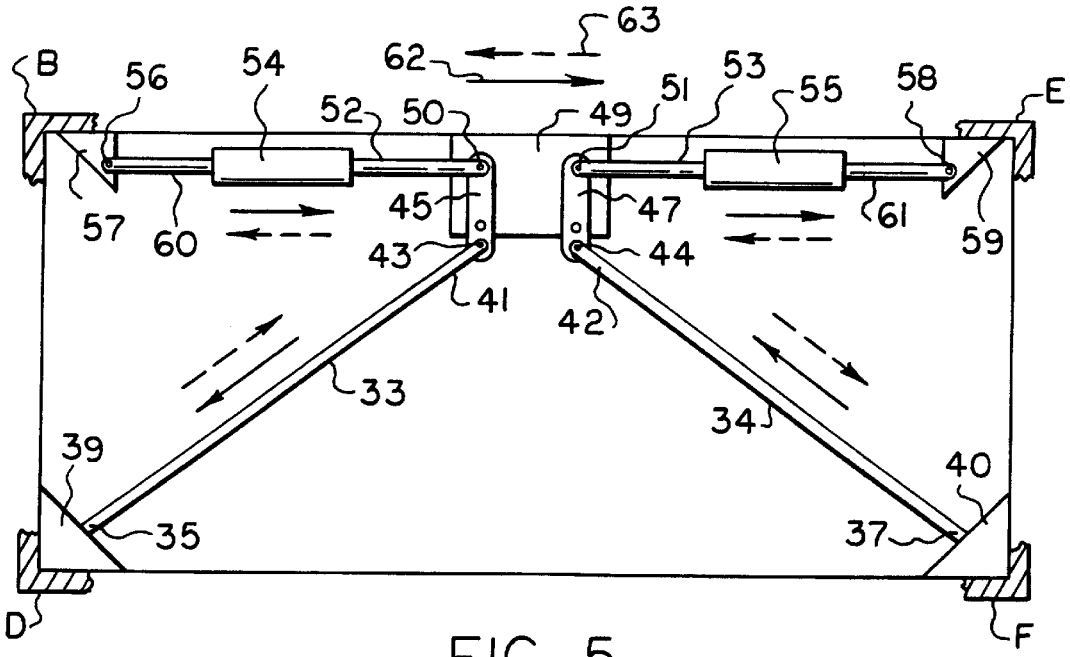
FIG. 5 is a schematic view of a chevron type of linkage utilizing a magnification type of linkage.

In FIG. 5 a building frame BDEF is shown which schematically shows a chevron type of seismic linkage. The chevron linkage includes elongated links 33 and 34 which have their lower ends 35 and 37, respectively, welded to gussets 39 and 40, respectively, at the corners of the frame. The upper ends 41 and 42 of links 33 and 34, respectively, are pivotally connected at 43 and 44, respectively, to lever type of links 45 and 47, respectively, which are pivotally mounted on member 49 at 46 and 48, respectively, which is rigidly attached to frame member BE. The upper ends of levers 45 and 47 are pivotally mounted at 50 and 51 to piston rods 52 and 53, respectively, of shock-absorbing members 54 and 55, respectively, which are pivotally connected at 56 and 58, respectively, to rigid members 57 and 59, respectively, by links 60 and 61, respectively. At this point it is to be again noted that the pivotal connections at 43, 44, 50, 51, 56 and 58 may be of the types shown in U.S. Pat. No. 5,870,863 and allowed application Ser. No. 08/975,129, filed Nov. 20, 1997, now U.S. Pat. No. 5,934,028, which are incorporated herein by reference provided that suitable clearances may be had with adjacent structural members.

Figure 6:
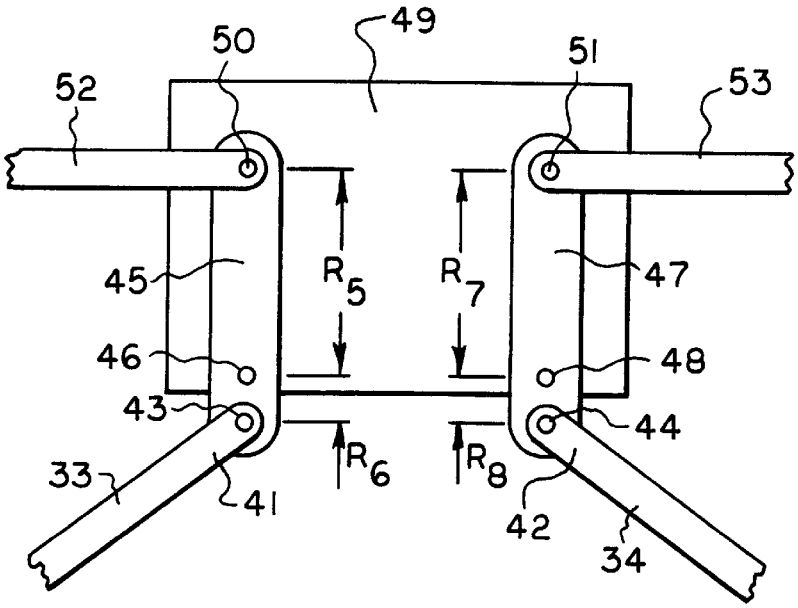
FIG. 6 is a enlarged fragmentary schematic view of a portion of the linkage of FIG. 5.

From schematic FIG. 6, which is not to scale, it can be seen that the magnification which lever 45 provides is the ratio of length $R_5$ to length $R_6$ and that the magnification which lever 47 provides is the ratio of length $R_7$ to length $R_8$. Here again, the ratios $R_5$:$R_6$ and $R_7$:$R_8$, should be in the range of about 10:1 for very stiff buildings.

When the floor 4 along frame member BE moves in the direction of solid arrow 62 relative to the floor 6 of frame member DF, the various links will move in corresponding directions indicated by solid arrows. When the floor 4 along frame member BE moves in the direction of dash arrow 63 relative to the floor 6 along frame member DF, the various links will also move in the direction of dash arrows associated therewith.

In FIGS. 2 and 5 shock-absorbing members 25 and 54 and 55 are shown. These shock-absorbing members preferably are seismic isolators such as shown in U.S. Pat. No. 5,462,141, dated Oct. 31, 1995, which is incorporated herein by reference. However, as noted in U.S. Pat. No. 5,870,863, the shock-absorbing member can be any suitable type of shock absorber or liquid spring or damper of any type or a combination of a liquid spring and damper. Also, as stated in U.S. Pat. No. 5,870,863, liquid springs of the type which can be used are shown in U.S. Pat. Nos. 4,582,303 and 4,064,977 and dampers such as shown in U.S. Pat. Nos. 4,638,895, 4,815,574 and 4,867,286, all of which are incorporated herein by reference.

Relative to the various embodiments shown in FIGS. 3, 4 and 6, it will be appreciated that the ratios $R_2$:$R_1$, $R_4$:$R_3$, $R_5$:$R_6$ and $R_7$:$R_8$ need not necessarily be the values listed above but may be any suitable magnification which may be required depending on the rigidity of the building and the characteristics of the shock-absorbing member which is being used.

While preferred embodiments of the present invention have been disclosed, it will be appreciated that it is not limited thereto but may be otherwise embodied within the scope of the following claims.

What is claimed is:

1. A motion-magnifying seismic shock-absorbing construction for placement in the polygonal frame of a structure comprising a first link having a shock-absorbing member therein, a first end on said first link for connection to a first area on said frame, a second end on said first link, a second link having a first end for connection to a second area on said frame remote from said first area, a second end on said second link, a third link in the form of a lever for connection to a third area on said frame remote from said first and second areas, said third link having a central portion, a pivotal connection on said frame mounting said central portion, first and second end portions on said third link extending outwardly from opposite sides of said pivotal connection, said second end of said first link being pivotally connected to said first end portion of said third link remote from said pivotal connection, and said second end of said second link being pivotally connected to said second end portion of said third link remote from said pivotal connection, said first and second end portions of said third link being dimensioned such that motion of said second link transmitted to said first link through said third link is always magnified by the pivotal action of said third link regardless of the direction of the force applied to said first link.

2. A motion-magnifying seismic shock-absorbing construction as set forth in claim 1 wherein said second link and said second end portion of said third link are practically in a straight line.

3. In a structure having a frame consisting of a plurality of frame members connected in a polygonal configuration, the improvement of a motion-magnifying seismic shock-absorbing construction comprising a first link having a shock-absorbing member therein, a first end on said first link connected to said frame at a first area, a second end on said first link, a second link having a first end connected to said frame at a second area which is remote from said first area, a second end on said second link, a third link in the form of a lever having a central portion connected to said frame at a third area remote from said first and second areas, a pivotal connection between said central portion and said frame, first and second end portions on said third link extending outwardly from opposite sides of said central portion thereof, said first end portion on said third link being pivotally connected to said second end of said first link at a first distance from said pivotal connection, and said second end portion on said third link being pivotally connected to said second end of said second link at a second distance from said pivotal connection, said first distance being greater than said second distance.

4. In a structure as set forth in claim 3 wherein said second link and said second end portion of said third link are practically in a straight line.

5. In a building structure having a plurality of polygonal frames and wherein there is a relatively small horizontal movement between the floors of the building in response to a seismic event, the improvement of motion-magnifying shock-absorbing constructions in each of said frames comprising a first link, a shock-absorbing member in said first link, a first end on said first link attached to said frame, a second end on said first link, a second link, a first end on said second link attached to said frame remote from said first end of said first link, a second end on said second link, and motion-magnifying linkage means attached at an area proximate said frame remote from said first ends of said first and second links and secured to said second ends of said first and second links, said motion-magnifying linkage means being dimensioned to always magnify motion of said second link transmitted to said first link having said shock-absorbing construction therein regardless of the direction of the force applied to said first link.

6. In a building structure having a plurality of polygonal frames and floors which move horizontally relative to each other in response to a seismic event, the improvement of a plurality of motion-magnifying shock-absorbing constructions each comprising a first link including a shock-absorbing member therein attached to each polygonal frame at a first area, a second link attached to each polygonal frame at a second area remote from said first area, and motion-magnifying linkage means attached at an area proximate each polygonal frame and to said first and second links remote from said first and second areas, said motion-magnifying linkage means being dimensioned to always magnify motion of said second link transmitted to said first link in response to relative horizontal movement of said floors regardless of the direction of the force applied to said first link.

7. A motion-magnifying seismic shock-absorbing construction for placement in the polygonal frame of a structure comprising a first link having a shock-absorbing member therein, a first end on said first link for connection to a first area on said frame, a second end on said first link, a second link having a first end for connection to a second area on said frame remote from said first area, a second end on said second link, a third link for connection to a third area on said frame remote from said first and second areas, a pivotal connection on said frame mounting said third link, an end portion on said third link extending outwardly from said pivotal connection, said second end of said first link being connected to said third link remote from said pivotal connection, said second end of said second link being pivotally connected to said second end portion of said third link remote from said pivotal connection, and said second link and said end portion of said third link being practically in a straight line.

* * * * *